US005615563A

United States Patent [19]

Matsuda et al.

[11] Patent Number: 5,615,563

[45] Date of Patent: Apr. 1, 1997

[54] KNIT SLIDE FASTENER WITH ZIGZAG WEFT ANCHORING STITCHES

[75] Inventors: Yoshio Matsuda; Hidenobu Kato; Yoshito Ikeguchi, all of Toyama-ken, Japan

[73] Assignee: YKK Corporation, Tokyo, Japan

[21] Appl. No.: 601,981

[22] Filed: Feb. 15, 1996

[30] Foreign Application Priority Data

Feb. 16, 1995 [JP] Japan ..... 7-067184

[51] Int. Cl.[6] ..... D04B 21/20; D04B 21/14

[52] U.S. Cl. ..... 66/193; 66/190; 66/192; 24/392

[58] Field of Search ..... 66/169 R, 170, 66/112 R, 190, 192, 193, 195, 202, 194; 24/392, 393, 397, 398, 391

[56] References Cited

U.S. PATENT DOCUMENTS 3,996,773 12/1976 Matsuda ..... 66/195
4,075,874 2/1978 Heimberger ..... 66/193
4,137,733 2/1979 Heimberger ..... 66/193
5,502,985 4/1996 Matsuda et al. ..... 66/193
5,502,986 4/1996 Matsuda et al. ..... 66/193
5,540,064 7/1996 Matsuda et al. ..... 66/193

*Primary Examiner*—C. D. Crowder
*Assistant Examiner*—Larry D. Worrell, Jr.
*Attorney, Agent, or Firm*—Hill, Steadman & Simpson

[57] ABSTRACT

A knit slide fastener comprises: a warp-knit fastener tape having along one longitudinal edge a fastener-element-mounting marginal portion; and a row of continuous fastener elements knitted in the fastener-element-mounting marginal portion simultaneously with the knitting of the warp-knit fastener tape; the fastener-element-mounting marginal portion including anchoring chain stitches knitted of a plurality of parallel knitting yarns for pressing down successive legs of the continuous fastener elements, and a plurality of anchoring weft inlaid yarns laid in weftwise in a zigzag pattern and between the parallel knitting yarns of the anchoring chain stitches, the anchoring weft inlaid yarns being interlaced with the chain stitches.

5 Claims, 9 Drawing Sheets

KNIT SLIDE FASTENER WITH ZIGZAG WEFT ANCHORING STITCHES

BACKGROUND OF THE INVENTION

1. Field of the Invention

This invention relates to a knit slide fastener having a row of fastener elements which is knitted in and along a longitudinal marginal portion of a warp-knit fastener tape simultaneously with the knitting of the warp-knit fastener tape.

2. Description of the Related Art

There are known various types of knit tapes for use in the field of slide fasteners. For example, Japanese Patent Publication No. SHO 38-11673 and Japanese Patent Laid-Open Publication No. HEI 2-255104 disclose a knit slide fastener comprising a knit fastener tape having a knit ground structure knitted of chain stitches and weft inlaid yarns, and a row of fastener elements of a plastic monofilament knitted in a longitudinal marginal portion of the knit fastener tape simultaneously with the knitting of the knit fastener tape, the fastener element row being knitted merely with the chain stitches of the knit ground structure.

However, in the conventional knit slide fastener, since the fastener element row is secured to the longitudinal marginal portion of the fastener tape only by part of the chain stitches of the knit ground structure, only a limited degree of securing force can be achieved due to a peculiar elasticity of the stitches themselves, and a split of the opposite coupled fastener element rows would tend to occur when the slide fastener is bent upon receipt of an upward thrust on one of opposite slide fastener surfaces.

SUMMARY OF THE INVENTION

With the foregoing conventional problems in view, it is an object of this invention to provide a knit slide fastener in which a fastener element row can be attached firmly with dimensional stability and which is adequately resistant against bending due to upward thrust on the slide fastener surface so that no split would occur even when the slide fastener is bent in use, guaranteeing a smooth movement of a slider.

In order to accomplish the above object, according to a first aspect of the invention, there is provided a knit slide fastener comprising: a warp-knit fastener tape having along one longitudinal edge a fastener-element-mounting marginal portion; and a row of continuous fastener elements knitted in the fastener-element-mounting marginal portion simultaneously with the knitting of the warp-knit fastener tape; the fastener-element-mounting marginal portion including anchoring chain stitches knitted of a plurality of parallel knitting yarns pressing down successive legs of the continuous fastener elements, and a plurality of anchoring weft inlaid yarns laid in weftwise in a zigzag pattern and between the parallel knitting yarns of the anchoring chain stitches, the anchoring weft inlaid yarns being interlaced with the anchoring chain stitches.

According to a second aspect of the invention, there is provided a knit slide fastener comprising: a warp-knit fastener tape having along one longitudinal edge a fastener-element-mounting marginal portion; and a row of continuous fastener elements knitted in the fastener-element-mounting marginal portion simultaneously with the knitting of the warp-knit fastener tape; the fastener-element-mounting marginal portion including anchoring double chain stitches knitted of a plurality of parallel knitting yarns for pressing down successive legs of the continuous fastener elements on front and back sides, and a plurality of anchoring weft inlaid yarns laid in weftwise in a zigzag pattern and between the parallel knitting yarns of the anchoring double chain stitches on the front and back sides, the anchoring weft inlaid yarns being interlaced with the anchoring double chain stitches.

DETAILED DESCRIPTION OF THE PREFERRED EMBODIMENTS

Figure 1:
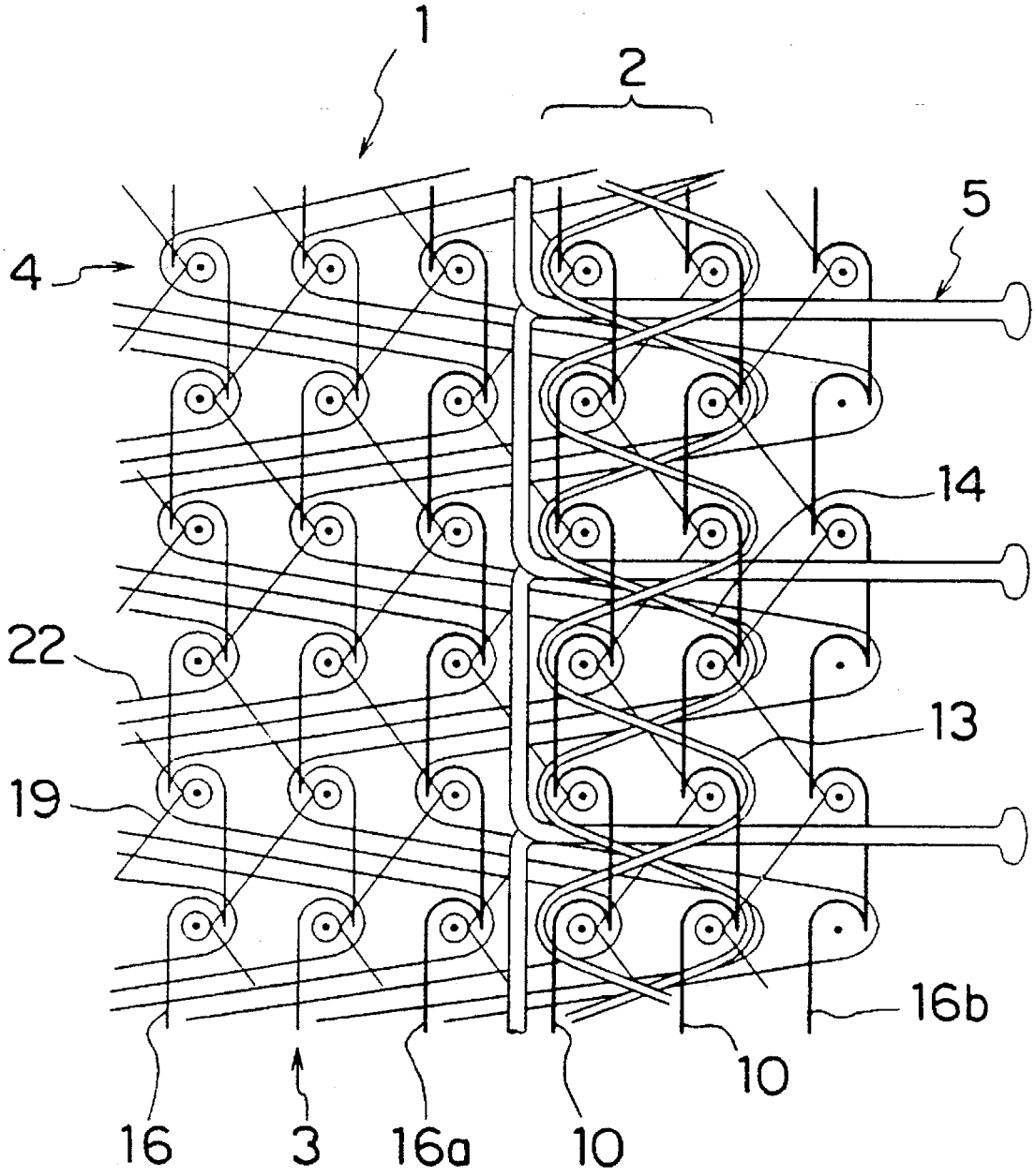
FIG. 1 is a diagram showing the structure of a tape, for a slide fastener, which is knitted with a single row of needle bed according to a first embodiment of this invention.
Figure 2:
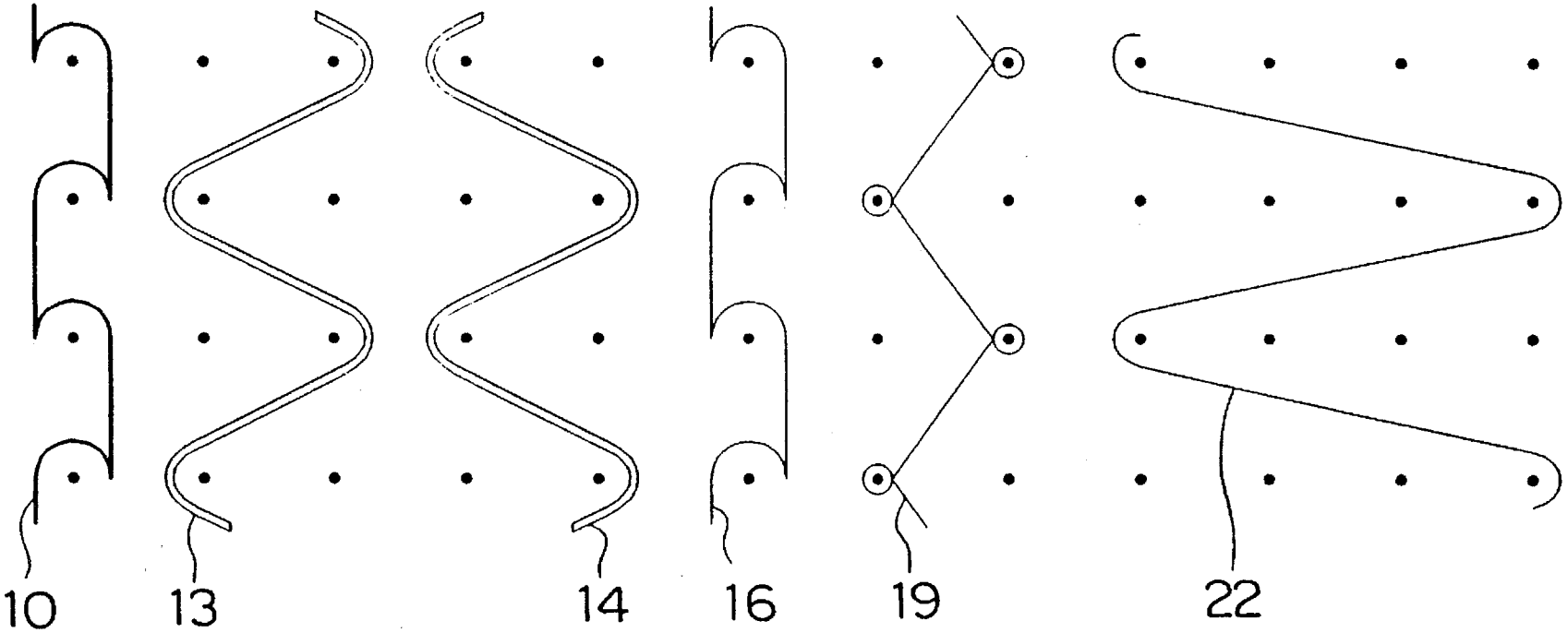
FIG. 2 is a diagram showing knitting patterns of the individual knitting yarns of the fastener tape of FIG. 1.
Figure 3:
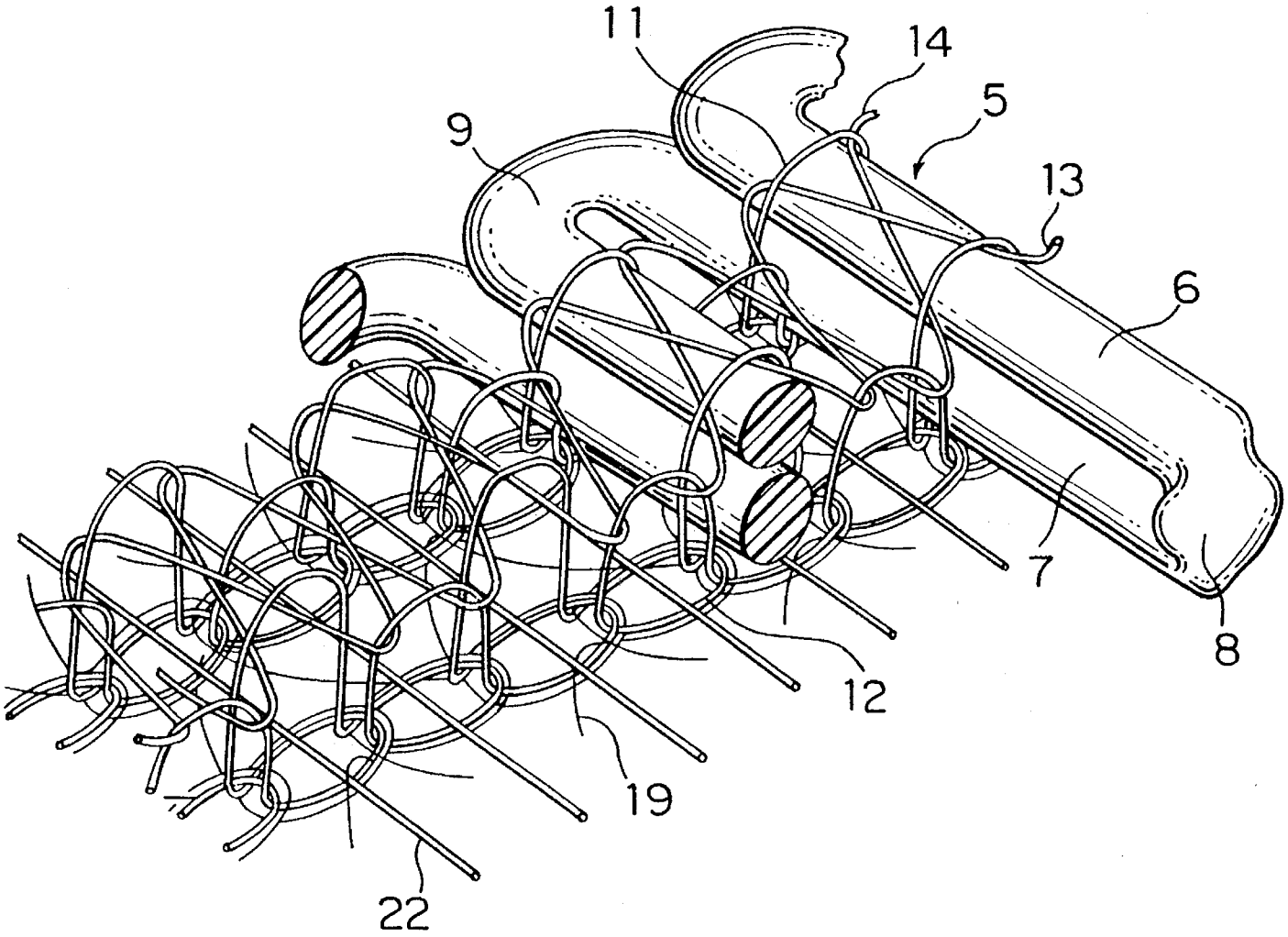
FIG. 3 is a schematic perspective view of the knit fastener tape of FIG. 1, showing the manner in which fastener elements are mounted on the fastener tape.
Figure 4:
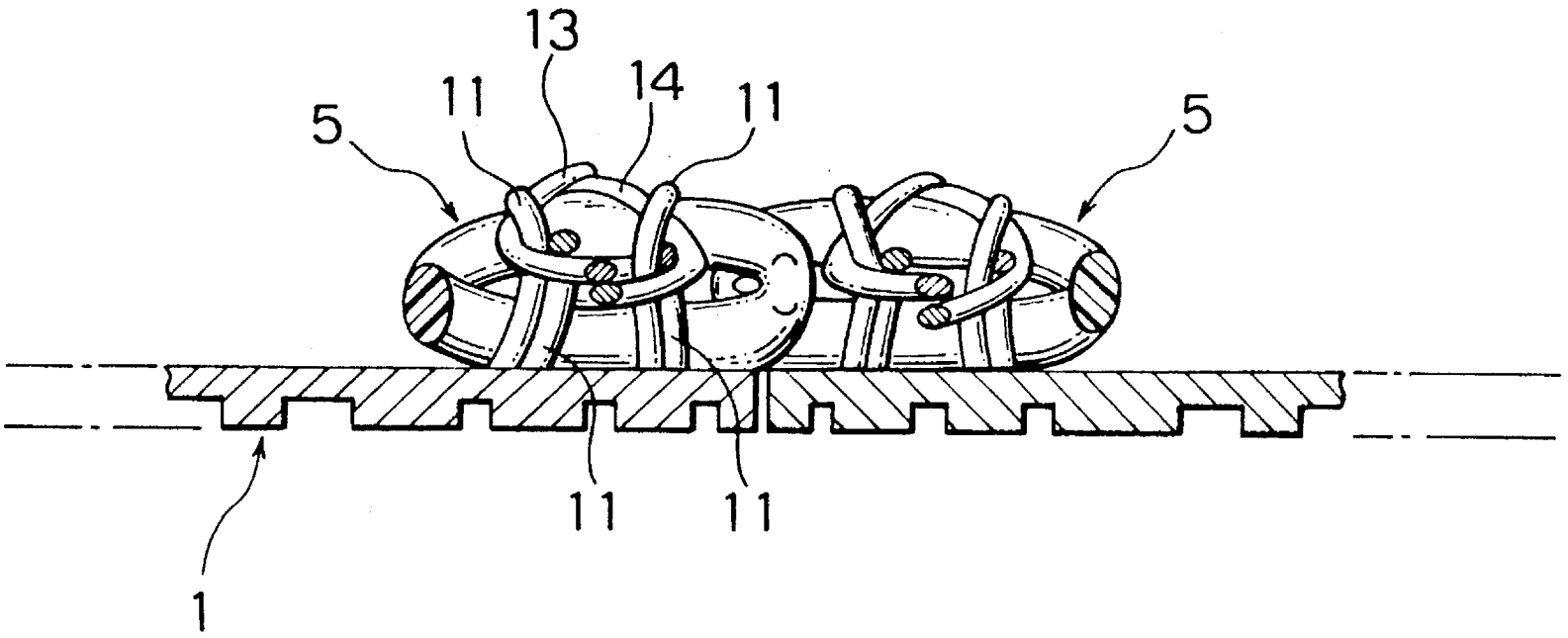
FIG. 4 is a fragmentary, transverse cross-sectional view showing the slide fastener according to the embodiment of FIG. 1 when a pair of rows of fastener elements are coupled.

Embodiments of this invention will now be described with reference to the accompanying drawings. FIG. 1 is a diagram showing a knit structure of a warp-knit tape, for a slide fastener, (hereinafter called the warp-knit fastener tape) according to a first embodiment of this invention. FIG. 2 is a diagram showing knitting patterns of the individual knitting yarns of the fastener tape of the first embodiment. FIGS. 3 and 4 schematically show the manner in which fastener elements are mounted on the fastener tape according to the first embodiment.

The warp-knit fastener tape 1 is knitted on an ordinary warp-knitting machine equipped with a single row of needle bed. The warp-knit fastener tape 1 has a single-face knit ground structure composed of tricot stitches 19 having a knitting pattern of 1-2/1-0, chain stitches 16 having a knitting pattern of 1-0/0-1, and weft inlaid yarns 22 each laid in weftwise in a zigzag pattern of 0-0/4-4 transversely across the fastener tape 1. The warp-knit fastener tape 1 has along one longitudinal edge a fastener-element-mounting marginal portion 2 composed of two wales 3, 3 on and along which a monofilament to be a coiled fastener-element row is mounted so as to go and return in every other courses 4 to form successive fastener elements 5. The successive fastener elements 5 have upper legs 6 pressed down by anchoring chain stitches 10 arranged in two parallel wales and knitted in a pattern of 1-0/0-1 and also by two anchoring weft inlaid yarns 13, 14. Thus the successive fastener elements 5 are knitted in the fastener-element-mounting marginal portion 2, as a coiled fastener element row, simultaneously with the knitting of the warp-knit fastener tape 1. The two anchoring weft inlaid yarns 13, 14 are laid in weft-wise in a zigzag pattern of 2-2/0-0 and a zigzag pattern of 0-0/2-2, respectively, so as to cross each other over the upper legs 6 of the fastener elements 5, being interlaced with sinker loops 11 of the anchoring chain stitches 10 without forming any stitch.

Figure 9:
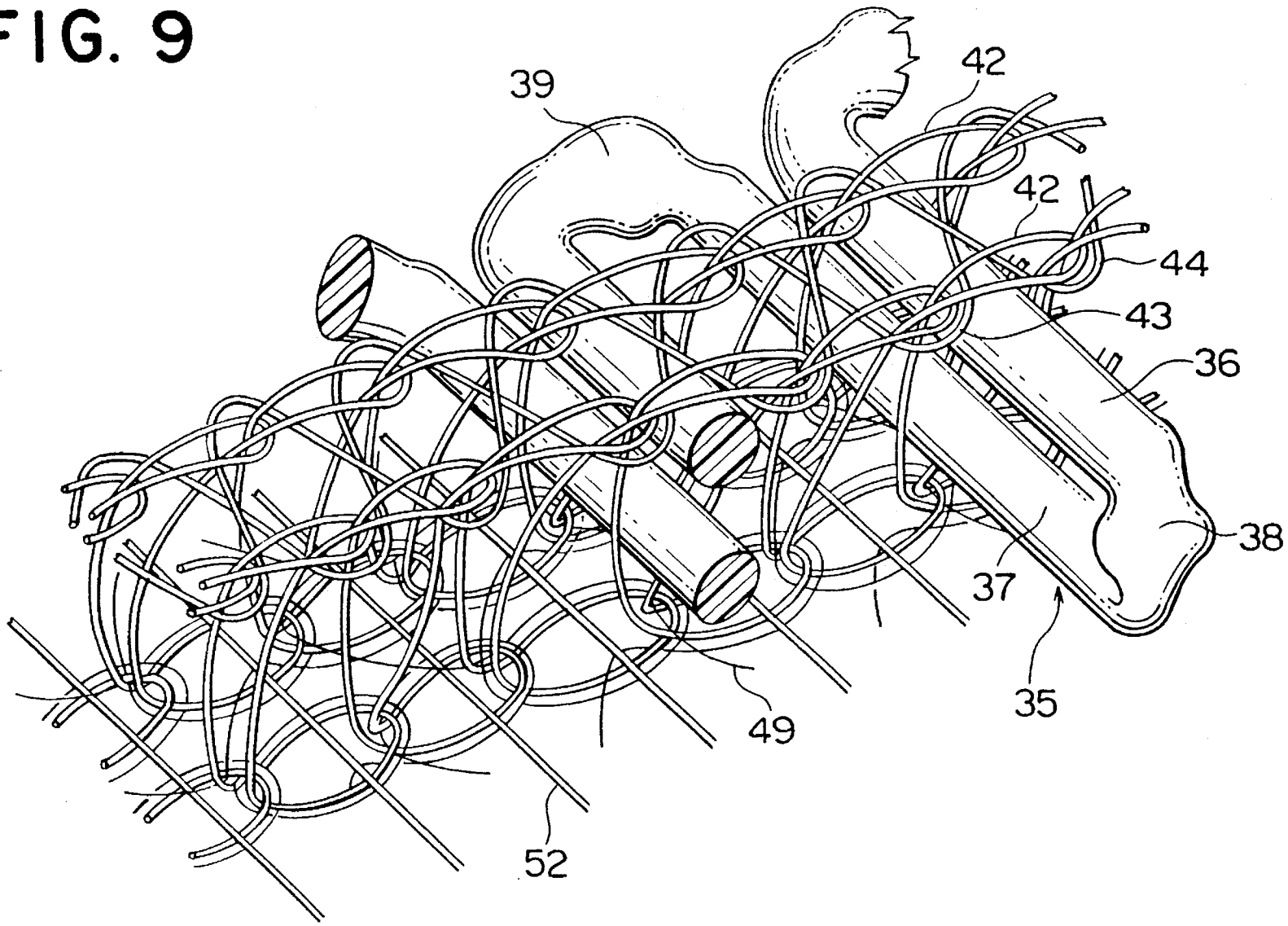
FIG. 9 is a schematic perspective view of the knit fastener tape of FIG. 7, showing the manner in which fastener elements are mounted on the fastener tape.

FIGS. 3 and 4 schematically show the manner in which the fastener elements 5 are mounted on the fastener tape 1. For the purpose of a better understanding, the tricot stitches 19 are shown in a single line; the weft inlaid yarns 22 are shown one in each course 4; and each knitting yarn as shown slender than actual, while stitches such as the individual needle loops are shown in a slackened posture. Actually, however, each of the yarns may be large or small in size, and the stitches may be tightened minutely, in order to meet the required features of a knit slide fastener. So is FIG. 9 showing the manner in which fastener elements 35 according to a second embodiment described below are mounted on the fastener tape 1.

The coiled fastener element row to be attached to the fastener-element-mounting marginal portion 2 of the fastener tape 1 is formed of a monofilament made of synthetic resin such as nylon or polyester. In production, the monofilament is previously flattened at portions to be coupling heads 8 and connecting portions 9 of a final fastener element row by stamping, and the resulting monofilament is laid in the marginal portion 2 of the fastener tape 1 in such a manner that the monofilament goes and returns runs in return trip in every other courses 4 and is bent at the flattened portions to be coupling heads 8 and connecting portions 9 of a final fastener element row in such a manner that successive upper legs 6 are arranged over and continuously to successive lower legs 7 in a coiled form, as shown in FIG. 3. In the marginal portion 2 composed of two wales 3, the coiled fastener element row is held by anchoring chain stitches 10 which are independent from chain stitches 16 of the ground structure of the warp-knit fastener tape 1 and anchoring weft inlaid yarns 13, 14. Specifically, sinker loops 11 of the anchoring chain stitches 10 extend so as to press down the successive upper legs 6 of the fastener elements 5, while needle loops 12 constitute part of the knit ground structure to serve to assist in making the marginal portion 2 longitudinally non-extendible and non-contractible, thus stabilizing the fastener elements 5 in dimension. In the meantime, the anchoring weft inlaid yarns 13, 14 are each laid in the marginal portion 2 so as to run weftwise in a zigzag pattern as transversely swung by the respective guide bars independently of weft inlaid yarns 22 of the knit ground structure, and are merely interlaced with the sinker loops 11 of the anchoring chain stitches 10 without forming any stitch. The two anchoring weft inlaid yarns 13, 14 cross each other over every upper leg 6 of the fastener elements 5 so as to press down the individual upper legs 6. As a result, the upper surface of the fastener element row is covered in part with these two anchoring weft inlaid yarns 13, 14, as shown in FIG. 4, so that the resulting slide fastener is kept free from any split, due to bending upon receipt of an upward thrust on the slide fastener surface, guaranteeing a smooth movement of the slider.

Figure 5:
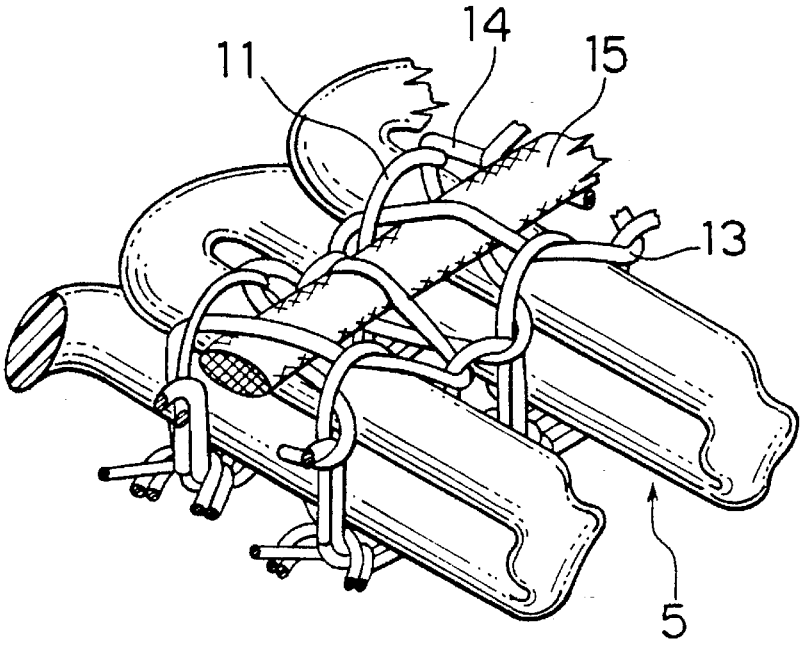
FIG. 5 is a fragmentary perspective view of the fastener tape of FIG. 1, showing the manner in which a warp inlaid cord is laid in between anchoring weft inlaid yarns.

FIG. 5 shows a modification of the foregoing embodiment in which a warp inlaid cord 15 is sandwiched between the two anchoring weft inlaid yarns 13, 14 arranged in the fastener-element-mounting marginal portion 2 for increasing the bending strength of the fastener element row and also for suppressing extension and contraction of the fastener element row. In FIG. 5, the warp inlaid cord 15 extends longitudinally along the fastener element row as sandwiched between the two anchoring weft inlaid yarns 13, 14 crossing each other over the fastener element row. Alternatively the warp inlaid cord 15 may extend as sandwiched between the tricot stitches 19 and the weft inlaid yarns 22, which constitute part of the knit ground structure under the fastener element row.

Figure 6:
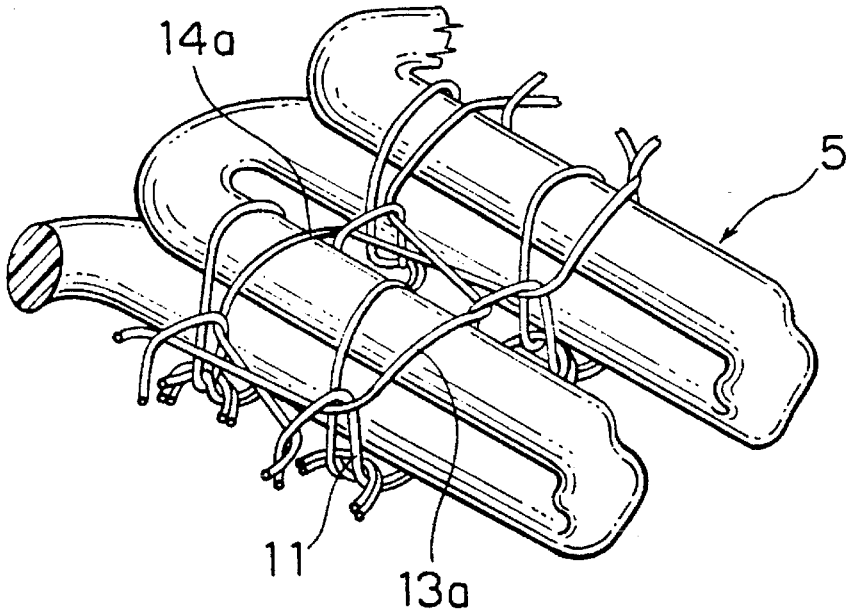
FIG. 6 is a fragmentary perspective view of a modification of the anchoring weft inlaid yarns of FIG. 1.

FIG. 6 shows another modification similar to the foregoing examples except that the anchoring weft inlaid yarns are arranged in an alternative way as the guide bars swing in a different way. In this modified form, the crossings of two anchoring inlaid yarns 13*a*, 14*a* are arranged one between the legs of the adjacent fastener elements 5, and the anchoring weft inlaid yarns 13*a*, 14*a* are laid in the marginal portion 2 so as to be interlaced with only the sinker loops 11 of the anchoring chain stitches 10 between adjacent legs of the fastener elements 5.

By using large-size and highly heat-contractible yarns for both the anchoring chain stitches 10 and the anchoring weft inlaid yarns 13, 14, it is possible to tighten the yarns firmly as they shrink during heat setting process after completion of the slide fastner, and also to increase dimensional stability of the fastener elements 5, thus attaching the fastener element row to the marginal portion 2 with increased firmness. Assuming that a monofilament for forming the coiled fastener element row has a rectangular or oval cross-sectional shape, it is possible to use and laid in the monofilament as the coiled fastener element row without stamping.

Figure 7:
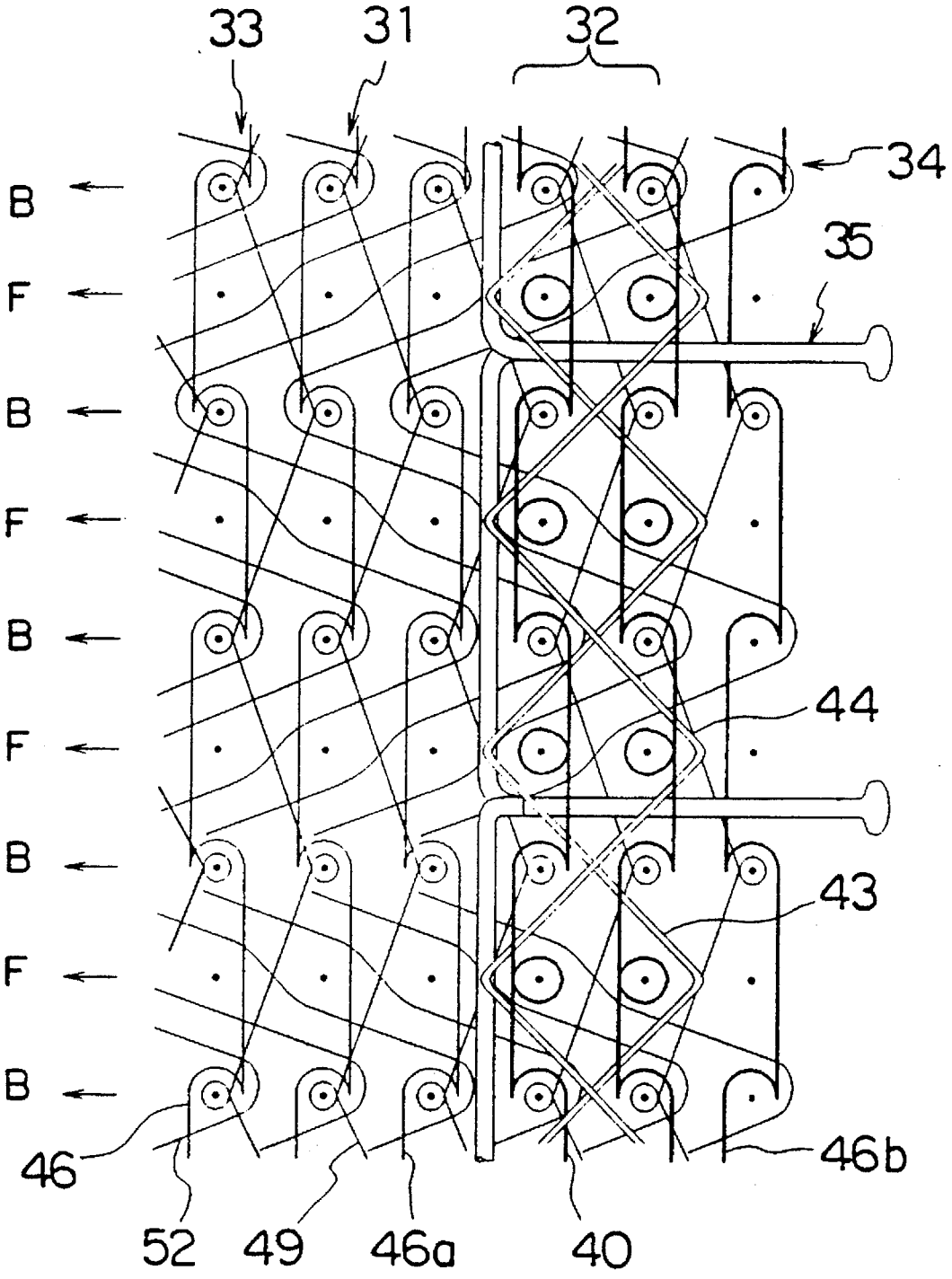
FIG. 7 is a diagram showing the structure of a tape knitted with front and back rows of needles according to a second embodiment of this invention.
Figure 8:
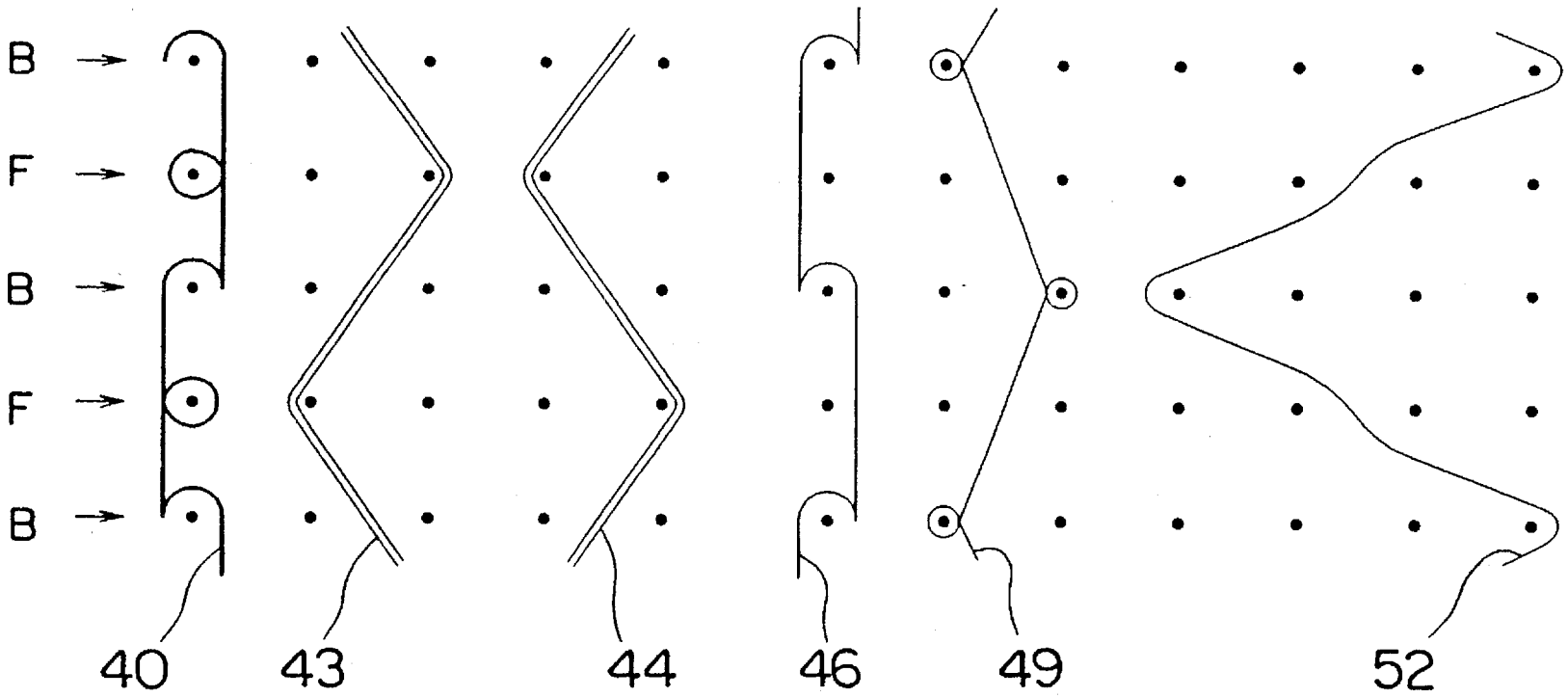
FIG. 8 is a diagram showing knitting patterns of the individual knitting yarns of the fastener tape of FIG. 7.
Figure 10:
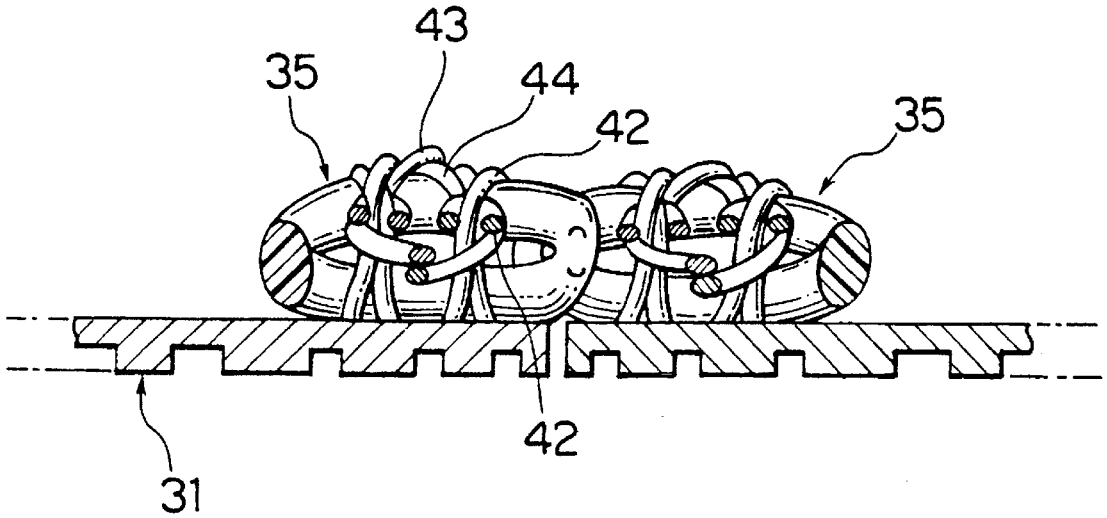
FIG. 10 is a fragmentary, transverse cross-sectional view showing the slide fastener according to the embodiment of FIG. 7 when a pair of rows of fastener elements are coupled.

FIG. 7 is a diagram showing a double-face warp-knit fastener tape according to a second embodiment of this invention. FIG. 8 is a diagram showing knitting patterns of the individual knitting yarns used for the fastener tape of second embodiment. FIGS. 9 and 10 schematically show the manner in which a coiled fastener element row is mounted on the fastener tape according to this embodiment.

The warp-knit fastener tape 31 is knitted on a double-face knitting machine (e.g., a double raschel knitting machine) equipped with a front row of needles (hereinafter called the front needles) F and a back row of needles (hereinafter called the back needles) B. The fastener tape 31 has a knit ground structure knitted of chain stitches 46 having a knitting pattern of 1-0/0-0 /0-1/1-1, tricot stitches 49 having a knitting pattern of 1-2/1-1/1-0/1-1, and weft inlaid yarns 52 having a zigzag pattern of 0-0/2-2/4-4/2-2 each running across and over four wales 33 of the fastener tape 31. The fastener tape 31 has along one longitudinal edge a fastener-element-mounting marginal portion 32 composed of two wales 33, on and along which a coiled monofilament made of synthetic resin such as nylon or polyester is mounted so as to go and return transversely in courses 4 to form successive fastener elements 35. As shown in FIG. 9, the upper and lower legs 36, 37 of each of the successive fastener elements 5 are pressed down by anchoring chain stitches 40 composed of two parallel knitting yarns knitted in the two wales 32 in a pattern of 0-1/1-0 /1-0/0-1 and also by two anchoring weft inlaid yarns 43, 44 having a pattern of 1-1/2-2/1-1/0-0 and a pattern of 1-1/0-0/1-1/2-2, respectively. Thus the successive fastener elements 5 are knitted in the fastener-element-mounting marginal portion 2, as a coiled fastener element row, simultaneously with the knitting of the warp-knit fastener tape 31. In the diagram of FIG. 7, the successive needle positions are shown alternately as the back needles B and the front needles F in every other courses 34. The front needles F form stitches over the upper surface of the coiled fastener element row to be knitted. Specifically, one of needle loops 42 of the anchoring chain stitches 40 having a double knit structure is formed on the upper side of the fastener element row and is interlaced with a succeeding needle loop 42 of the same anchoring chain stitches 40. As this knitting is repeated, a succession of stitches are formed longitudinally along the coiled fastener element row. In the meantime, the back needles B knit a web portion, which is the remaining tape part other than the fastener-element-mounting marginal portion, and part of the fastener-element-mounting marginal portion 32 to place the fastener element row thereon. In this embodiment, the fastener tape 31 is knitted of the chain stitches 46, the tricot stitches 49 and the weft inlaid yarns 52, and the other needle loop 42 of the anchoring stitches 40 are formed on the lower side of the fastener element row and are interlaced with the tricot stitches 49 of the chain stitches 46 of the ground structure. As this knitting is repeated, a succession of stitches are formed longitudinally along the coiled fastener element row, thus making the fastener-element-mounting marginal portion 32 minute in knit structure.

As shown in FIGS. 7 and 9, the lower needle loops 42 of the anchoring chain stitches 40 are interlaced with both needle loops of the chain stitches 46 and needle loops of the tricot stitches 49 of the ground structure, while the upper needle loops of the same anchoring chain stitches 40 serve to assist in pressing down the upper and lower legs 36, 37 of successive fastener elements 35 of the coiled fastener element row by their individual stitches and the anchoring weft inlaid yarns 43, 44. The anchoring weft inlaid yarns 43, 44 each extend weftwise in a zigzag pattern across the marginal portion 32 so as to be only interlaced with the needle loops 42 of the anchoring chain stitches 40, which press down the upper and lower legs 36, 37 of the fastener elements 35, without forming any stitch. These two anchoring weft inlaid yarns 43, 44 cross each other over the upper legs 36 of the fastener elements 35, serving to press down the upper and lower legs 36, 37 of the fastener elements 35 in cooperation with the needle loops 42 of the anchoring chain stitches 40, as shown in FIG. 10. The anchoring weft inlaid yarns 43, 44 are interlaced with the needle loops 42 of the anchoring chain stitches 40 as each of the anchoring weft inlaid yarn 43, 44 is swung in a zigzag pattern by the respective guide bar independent of the weft inlaid yarns 52 of the ground structure.

Figure 11:
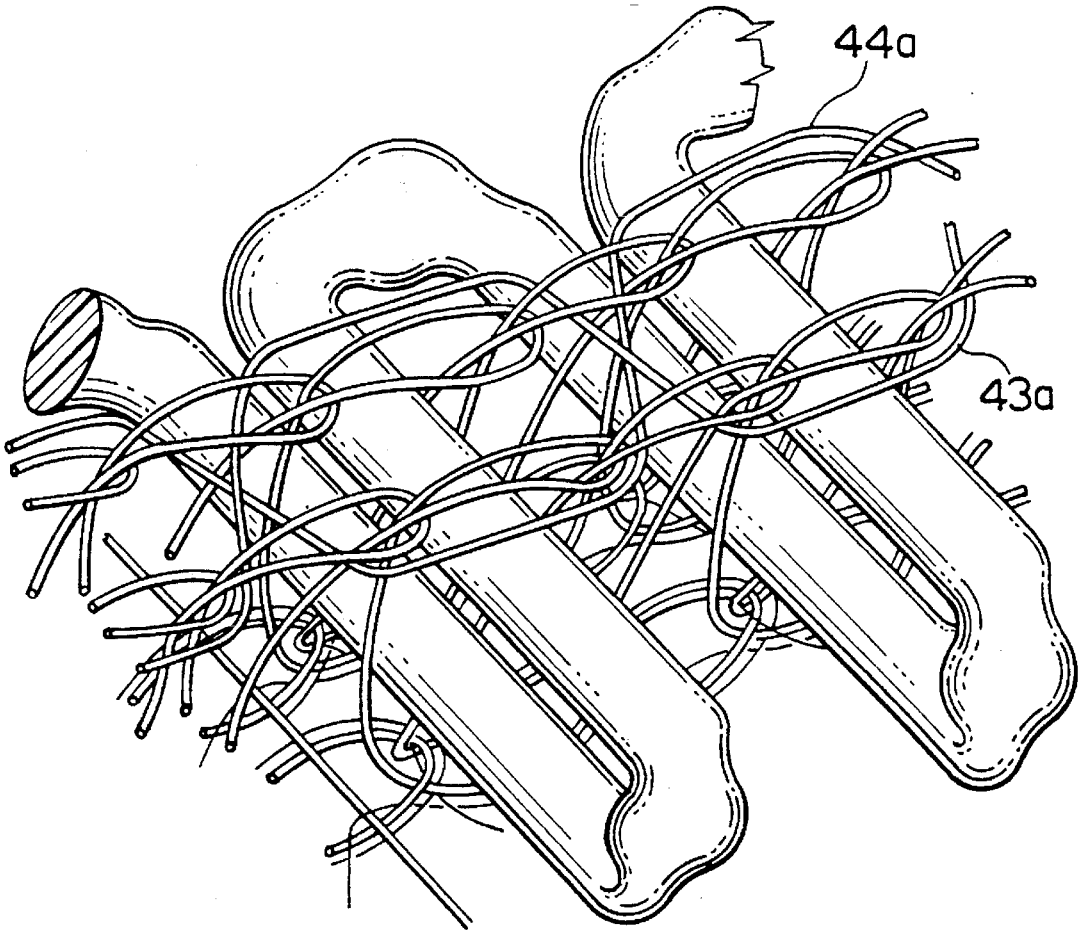
FIG. 11 is a fragmentary perspective view of a modification of the anchoring weft inlaid yarns of FIG. 7.

FIG. 11 shows a modification similar to the second embodiment except that the anchoring weft inlaid yarns **43*a*, 44*a* are arranged in an alternative way as the guide bars swing in a different way. In this modified form, the crossings of two anchoring inlaid yarns 43*a*, 44*a* are arranged one between the legs of the adjacent fastener elements 35, and the anchoring weft inlaid yarns 43*a*, 44*a* are laid in the marginal portion 32 so as to be interlaced with only the needle loops 42 of the anchoring chain stitches 40 between adjacent legs of the fastener elements 35, thus suppressing extension and contraction of the fastener element row so that the fastener elements 35** would be kept free from any error in interelement pitch.

Using large-size and highly heat-contractible yarns for both the anchoring chain stitches 40 and the anchoring weft inlaid yarns 43, 44, it is possible to tighten the yarns firmly as they shrink during heat setting process after completion of the slide fastner, and also to increase dimensional stability of the fastener elements 35, thus attaching the fastener element row to the marginal portion with increased firmness.

In production, likewise the first embodiment, the synthetic resin monofilament for forming a coiled fastener element row is previously flattened at portions to be coupling heads 38 and connecting portions 39 of a final fastener element row by stamping, and the stamped monofilament is supplied to between the front needles F and the back needles B of the warp-knitting machine. Thus the monofilament is laid in the marginal portion 32 of the fastener tape 31 in such a manner that the monofilament goes and returns transversely in every other courses 34 and is bent at the flattened portions to be coupling heads 38 and connecting portions 39 of a final fastener element row. Assuming that a monofilament for forming the coiled fastener element row has a rectangular or oval cross-sectional shape, it is possible to use and laid in the monofilament as the coiled fastener element row without stamping.

In this embodiment, the back needles B knit part of a web portion of the fastener tape and part of the fastener-element-mounting marginal portion to place the fastener element row thereon, while the front needles F knit a structure for anchoring the coiled fastener element row. Alternatively, the front needles F may knit part of the web portion and that part of the fastener-element-mounting marginal portion, while the back needles B may knit the structure for anchoring the coiled fastener element row.

Further, in this embodiment, the anchoring chain stitches have closed stitches over the upper surface of the coiled fastener element row. Alternatively such closed stitches may be substituted by open stitches. Still further, the anchoring chain stitches have open stitches on the lower side of the fastener-element-mounting marginal portion of the fastener tape; also in such an event, the open stitches may be substituted by closed stitches. In another alternative form, all stitches of the anchoring chain stitches may be either open or closed.

In the foregoing knit slide fastener according to this invention, partly since a continuous fastener element row is knitted in the fastener-element-mounting marginal portion of the ward-knit fastener tape simultaneously with the knitting of the fastener tape, and partly since the anchoring weft inlaid yarns are inlaid in the fastener-element-mounting marginal portion and are interlaced with the anchoring chain stitches knitted in a single-face or double-face knit structure, it is possible to anchor the fastener elements with dimensional stability and also to give the slide fastener adequate resistance against bending due to an upward thrust on the slide fastener upwardly, thus preventing any split of opposed fastener element rows. In the illustrated embodiments, the anchoring chain stitches are composed of two knitting yarns. The number of the knitting yarns for the anchoring chain stitches, however, may be decided, depending on the size of the fastener element row, based on which the number of the anchoring weft inlaid yarns can be also decided. The width, i.e. the number of wales, of the fastener-element-mounting marginal portion depends on the number of yarns for the anchoring chain stitches, but usually, it has a width of two or three wales. The outermost wale may be or may not be used for the anchoring purpose.

Assuming that the yarns for the chain stitches **16*a*, 46*a* of the fastener tape portion contiguous to the anchoring chain stitches are larger in size than those for the chain stitches 16, 46 of the remaining fastener tape portion, it is possible to facilitate moving the slider to open or close the opposed fastener element rows. Also, if the yarns for the chain stitches 16***b*, 46*b* of the ground structure in the outermost tape edge portion contiguous to the anchoring chain stitches 16*a*, 46*a* are larger in size than those for the chain stitches 16, 46 of the remaining fastener tape portion, it is possible to keep the edge portion in proper shape and also to reinforce the edge portion.

Further, in the illustrated embodiments, the continuous fastener element row is a coiled form. However, this invention should by no means be limited to this illustrated example and may be applied also to a so-called zigzag type, in which the monofilament is bent so as to form a succession of horizontal Us in the plane of the slide fastener, the successive Us being connected one to another alternately on the front and back sides of the fastener tape 1. This invention may be applied also to a concealed slide fastener, which is manufactured by attaching a monofilament having coupling-head-forming portions and connecting-portion-forming portions arranged at positions different from those in the foregoing examples and then by folding back the resulting fastener-element-mounting marginal portion to couple the fastener element row with the fastener element row of a companion marginal portion as folded back in the same way.

In the foregoing embodiments, the ground structure of the fastener tape is knit of chain stitches 16, 16*a*, 16*b*, 46, 46*a*, 46*b*, tricot stitches 19, 49 and weft inlaid yarns 22, 52. Alternatively such tricot stitches 19, 49 may be substituted by two-needle stitches with the same results.

With the foregoing arrangement of this invention, since the anchoring weft inlaid yarns 13, 13*a*, 14, 14*a*, 43, 43*a*, 44, 44*a* are laid in the fastener-element-mounting marginal portion 2, 32 in a zigzag pattern between a plurality of yarns of anchoring chain stitches 10, 40 and are interlaced with the anchoring chain stitches 10, 40 so as to press down the fastener element row 5, 35 in cooperation with the anchoring chain stitches 10, 40, it is possible to suppress warpwise expansion and contraction of the fastener element row 5, 35 so that an interelement pitch error would scarcely occur, thus realizing dimensional stability. Also it is possible to give the slide fastener adequate resistance against bending due to an upward thrust on the slide fastener surface so that the slide fastener is prevented from any split when bent in use, thus guaranteeing smooth movements of the slider. Further, since on the upper surface of the fastener element row 5, 35, the anchoring weft inlaid yarns 13, 13*a*, 14, 14*a*, 43, 43*a*, 44, 44*a* are arranged in a zigzag pattern in addition to the stitches of the anchoring chain stitches 10, 40, it is possible to cover the fastener element row 5, 35 to an increased extent, thus improving the proofness against ironing.

In the fastener-element-mounting marginal portion 2, 32 according to the second embodiment, the anchoring chain stitches 10, 40 of parallel knitting yarns are knitted into a double-face structure, and the anchoring weft inlaid yarns 13, 13*a*, 14, 14*a*, 43, 43*a*, 44, 44*a* are laid in between the anchoring chain stitches 10, 40 in a zigzag pattern and are interlaced with the anchoring chain stitches 10, 40 so as to press down the fastener element row 5, 35 in cooperation with the anchoring chain stitches 10, 40. The double-face knit slide fastener has the same result as the single-face knit slide fastener in which the anchoring chain stitches 10, 40 of parallel knitting yarns are knit in a single-face structure, and in which the anchoring weft inlaid yarns 13, 13*a*, 14, 14*a*, 43, 43*a*, 44, 44*a* are interlaced with the anchoring chain stitches 10, 40.

What is claimed is:

1. A knit slide fastener comprising:

(a) a warp-knit fastener tape having along one longitudinal edge a fastener-element-mounting marginal portion; and (b) a row of continuous fastener elements knitted in said fastener-element-mounting marginal portion simultaneously with the knitting of said warp-knit fastener tape;

(c) said fastener-element-mounting marginal portion including anchoring chain stitches knitted of a plurality of parallel knitting yarns for pressing down successive legs of said continuous fastener elements, and a plurality of anchoring weft inlaid yarns laid in weftwise in a zigzag pattern and between said parallel knitting yarns of said anchoring chain stitches, said anchoring weft inlaid yarns being interlaced with said anchoring chain stitches.

2. A knit slide fastener according to claim 1, further comprising a warp inlaid cord sandwiched between said plurality of anchoring weft inlaid yarns arranged in said fastener-element-mounting marginal portion.

3. A knit slide fastener according to claim 1, wherein said plurality of anchoring inlaid yarns are crossed respectively between said legs of adjacent fastener elements in said fastener-element-mounting marginal portion so as to be interlaced with only sinker loops of said anchoring chain stitches between said legs of adjacent fastener elements.

4. A knit slide fastener comprising:

(a) a warp-knit fastener tape having along one longitudinal edge a fastener-element-mounting marginal portion; and (b) a row of continuous fastener elements knitted in said fastener-element-mounting marginal portion simultaneously with the knitting of said warp-knit fastener tape;

(c) said fastener-element-mounting marginal portion including anchoring double chain stitches knitted of a plurality of parallel knitting yarns for pressing down successive legs of said continuous fastener elements on front and back sides, and a plurality of anchoring weft inlaid yarns laid in weftwise in a zigzag pattern and between said parallel knitting yarns of said anchoring double chain stitches on the front and back sides, said anchoring weft inlaid yarns being interlaced with said anchoring double chain stitches.

5. A knit slide fastener according to claim 4, wherein said plurality of anchoring inlaid yarns are crossed respectively between said legs of adjacent fastener elements in said fastener-element-mounting marginal portion so as to be interlaced with only needle loops of said anchoring chain stitches between said legs of adjacent fastener elements.

* * * * *